US007283096B2

(12) United States Patent
Geisheimer et al.

(10) Patent No.: US 7,283,096 B2
(45) Date of Patent: Oct. 16, 2007

(54) MICROSTRIP PATCH ANTENNA FOR HIGH TEMPERATURE ENVIRONMENTS

(75) Inventors: Jonathan L. Geisheimer, Atlanta, GA (US); Scott A. Billington, Atlanta, GA (US); David Burgess, Atlanta, GA (US); Glenn Hopkins, Marietta, GA (US)

(73) Assignee: Radatec, Inc., Londonderry, NH (US)

( * ) Notice: Subject to any disclaimer, the term of this patent is extended or adjusted under 35 U.S.C. 154(b) by 0 days.

(21) Appl. No.: 11/351,422

(22) Filed: Feb. 10, 2006

(65) Prior Publication Data

US 2007/0024505 A1 Feb. 1, 2007

Related U.S. Application Data

(60) Provisional application No. 60/652,231, filed on Feb. 11, 2005.

(51) Int. Cl.
*H01Q 1/38* (2006.01)
*H01Q 1/42* (2006.01)

(52) U.S. Cl. ..... 343/700 MS; 343/789; 343/872

(58) Field of Classification Search ..... 343/700 MS, 343/789, 846, 872
See application file for complete search history.

(56) References Cited

U.S. PATENT DOCUMENTS

| | | | | |
|---|---|---|---|---|
| 4,384,819 | A | 5/1983 | Baker | 415/14 |
| 4,700,127 | A | 10/1987 | Sasaki et al. | 324/58.5 |
| 5,384,542 | A | 1/1995 | Lahitte et al. | 324/642 |
| 5,818,242 | A | 10/1998 | Grzybowski et al. | 324/462 |
| 5,977,710 | A | 11/1999 | Kuramoto et al. | 343/700 MS |
| 6,241,184 | B1 | 6/2001 | Sunne et al. | 244/117 A |
| 6,378,437 | B1 | 4/2002 | Burke, Jr. et al. | 102/293 |
| 6,489,917 | B2 | 12/2002 | Geisheimer et al. | 342/127 |
| 6,778,141 | B1 | 8/2004 | Yeh | 343/700 MS |
| 6,856,281 | B2 | 2/2005 | Billington et al. | 342/174 |
| 6,977,613 | B2 | 12/2005 | He et al. | 343/700 MS |
| 6,992,640 | B2 | 1/2006 | Usami et al. | 343/872 |
| 7,043,280 | B1 * | 5/2006 | Shields et al. | 455/575.1 |

(Continued)

OTHER PUBLICATIONS

Hassani, H. R., "Analysis of triangular patch antennas including radome effects," *IEE Proceedings of Microwaves, Antennas and Propagation*, vol. 139, Issue 3, Jun. 1992, pp. 251-256.

Ingvarson, P., "High temperature antennas for the Hermes spaceplane," IEEE Antennas and Propagation Society International Symposium, 1991, Jun. 1991, vol. 3, pp. 1590-1593.

(Continued)

*Primary Examiner*—Shih-Chao Chen
(74) *Attorney, Agent, or Firm*—King & Spalding LLP

(57) ABSTRACT

A patch antenna for operation within a high temperature environment. The patent antenna typically includes an antenna radiating element, a housing and a microwave transmission medium, such as a high temperature microwave cable. The antenna radiating element typically comprises a metallization (or solid metal) element in contact with a dielectric element. The antenna radiating element can include a dielectric window comprising a flame spray coating or a solid dielectric material placed in front of the radiating element. The antenna element is typically inserted into a housing that mechanically captures the antenna and provides a ground plane for the antenna. Orifices or passages can be added to the housing to improve high temperature performance and may direct cooling air for cooling the antenna. The high temperature microwave cable is typically inserted into the housing and attached to the antenna radiator to support the communication of electromagnetic signals between the radiator element and a receiver or transmitter device.

31 Claims, 8 Drawing Sheets

U.S. PATENT DOCUMENTS

| | | | | |
|---|---|---|---|---|
| 7,053,835 | B2 * | 5/2006 | Noro et al. | 343/700 MS |
| 2005/0146467 | A1 | 7/2005 | He et al. | |

OTHER PUBLICATIONS

Hauser, R. et al., "Ceramic patch antenna for high temperature applications," Electronics Technology: Meeting the Challenges of Electronics Technology Progress, 2005, 28th International Spring Seminar on, May 19-20, 2005, pp. 173-178.

Kulhman, E., "Investigation of high temperature antenna designs for space shuttle," IEEE Antennas and Propagation Society International Symposium, 1974, vol. 12, Jun. 1974, pp. 210-213.

Kabacik, et al., "Microstrip patch antenna design considerations for airborne and spaceborne applications," IEEE Antennas and Propagation Society International Symposium, 1998, vol. 4, Jun. 1998, pp. 2120-2123.

PCT/US06/04697, International Search Report, Nov. 28, 2006.

* cited by examiner 200
102
103
201

201
103
102
200

MICROSTRIP PATCH ANTENNA FOR HIGH TEMPERATURE ENVIRONMENTS

RELATED APPLICATION

Applicants claim priority under 35 U.S.C. 119 to an earlier-filed provisional patent application, U.S. Provisional Patent Application Ser. No. 60/652,231 filed on Feb. 11, 2005, entitled "A High Temperature Probe for Displacement Measurements". The subject matter disclosed by this provisional patent application is fully incorporated within the present application by reference herein.

TECHNICAL FIELD

The present invention relates to patch antennas for transmitting and receiving electromagnetic energy and more particularly to the design and use of patch antennas within high temperature environments.

BACKGROUND OF INVENTION

Antennas are used to transmit and receive electromagnetic energy. Typically, they are used within ambient temperature environments and are used in such devices as mobile phones, radios, global positioning receivers, and radar systems. Patch antennas, sometimes referred to as microstrip antennas, typically are an antenna design consisting of a metallization applied to a dielectric substrate material. Many such designs are constructed with printed circuit board etching processes common in circuit board manufacture. The geometry of the design is typically rectangular or circular, but other geometries are possible to provide enhanced performance such as increased bandwidth or directionality.

Additionally, microwave-based sensors have been developed specifically for use in high temperature environments. Next generation sensor systems are used in high temperature environments that require an antenna to be exposed to combustion gases. These microwave systems enable advanced control and instrumentation systems for next-generation aircraft and power generating turbine engines.

Sensors operating within the environment of a turbine engine are frequently required to survive in gas path temperatures exceeding 2000° F. for over 12,000 operating hours. Traditional patch antennas found in consumer, industrial, and military systems are not built of construction methods or materials that can survive a short period of time in such high temperatures, let alone survive and operate reliability for thousands of hours. Patch antennas have not yet been implemented in such harsh environments to date.

Radomes have been used as dielectric windows to protect antennas from the elements as well as extended temperatures during missile vehicle re-entry into the atmosphere. These radomes are typically large structures made from a low dielectric constant that allow electromagnetic energy to pass through with a minimum of attenuation. Radomes on missile re-entry vehicles typically have to protect the antenna on the order of minutes and will often use ablative coating and additional thermal management systems to lower the temperature of the antenna. Traditional radome approaches to improving the survivability of a patch antenna are not well suited for extended life applications.

Finally, the dielectric constant of substrate materials changes as a function of temperature. Since patch antennas typically operate as a resonant structure whose resonance is closely coupled to the dielectric constant of the substrate, the center frequency of the antenna can change as a function of temperature. This requires that the transmit frequency be appropriately changed to match the center frequency of the antenna in order for the antenna to radiate electromagnetic energy efficiently. Therefore, in order to reduce system complexity and the total transmit bandwidth of the electronics, it is desirable to minimize the shift in antenna resonant frequency as a function of temperature.

Implementing a long-life patch antenna for high temperature environments requires a different approach than that found in the prior art. Thus, a heretofore unaddressed need exists in the industry to address the aforementioned deficiencies and inadequacies.

SUMMARY OF INVENTION

The present invention improves the performance and reliability of a patch antenna within a high temperature environment. The inventive patch antenna includes an antenna radiating element, typically placed within a housing or probe assembly having passages or orifices for distributing air within the housing and to the antenna radiating element. This combination of a patch antenna and housing is useful as a probe for use in measuring characteristics of equipment or devices that operate at a high temperature, typically greater than 600 degrees Fahrenheit. The 600 degrees Fahrenheit. The antenna radiating element typically comprises metallization (or solid metals) in contact with a ceramic, and may have a dielectric window consisting of a flame spray coating or a solid dielectric material in front of the radiating element. The antenna element is inserted into a probe body that mechanically captures the antenna and provides the necessary ground plane of the antenna to operate. The probe body may contain cooling orifices or passages, commonly referred to as cooling holes, to improve high temperature performance and may direct air through the antenna element itself. A high temperature microwave cable is inserted into the probe body and attached to the antenna radiator. These parts can be joined together with high temperature brazing, welding, or ceramic adhesive processes. The joining technology creates effective bonds that last in high temperature environments.

One aspect of the invention is the antenna radiating element, referred to as the puck, typically comprising a piece of solid dielectric material with a metallization applied. A high temperature metallization can be applied to the dielectric material via a standard thin film or thick film process, or a solid piece of metal can be brazed onto the dielectric material. The metallization shape or pattern provides the necessary geometry for the radiating element and, in addition, an attachment for the ground plane on the back side. The use of a dielectric material with a low change in dielectric constant as a function of temperature can minimize changes in the antenna center frequency as the temperature if the application environment changes. A dielectric window may be placed on top of the puck to provide additional thermal and environmental protection. The window may be of a standard plasma flame spray coating type, or it may comprise a solid piece of dielectric material. If a solid dielectric material is used, the patch geometry is preferably modified to provide the correct impedance match to the dielectric window, which will allow the antenna to radiate in the most efficient manner.

The probe body is a piece of metal that is used to mechanically retain the puck as well as provide the mechanical and electrical attachment between the microwave cable and the puck. The probe body outer dimensions allow the entire assembly to be installed into the system where the antenna is desired to be used. The probe body may contain cooling holes or other orifices that can be used as part of an active cooling system to improve the antenna performance in the hottest of environments.

The microwave cable allows the antenna to be connected to the transmitter and/or receiver electronics such that microwave energy can be efficiently transmitted via the antenna. The cable is of a high temperature construction that allows it to operate in the same environment as the probe. It is mechanically attached to the probe body to allow proper electrical connection to the ground plane.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of exemplary embodiments of the present invention. Moreover, in the drawings, reference numerals designate corresponding parts throughout the several views.

DETAILED DESCRIPTION OF THE EXEMPLARY EMBODIMENTS

Exemplary embodiments of the present invention provide for a patch antenna capable of operating within a high temperature environment for extended periods of time. For the purpose of this disclosure, a high temperature environment is defined by an environment having a temperature of or greater than 600° F.

Figure 1A:
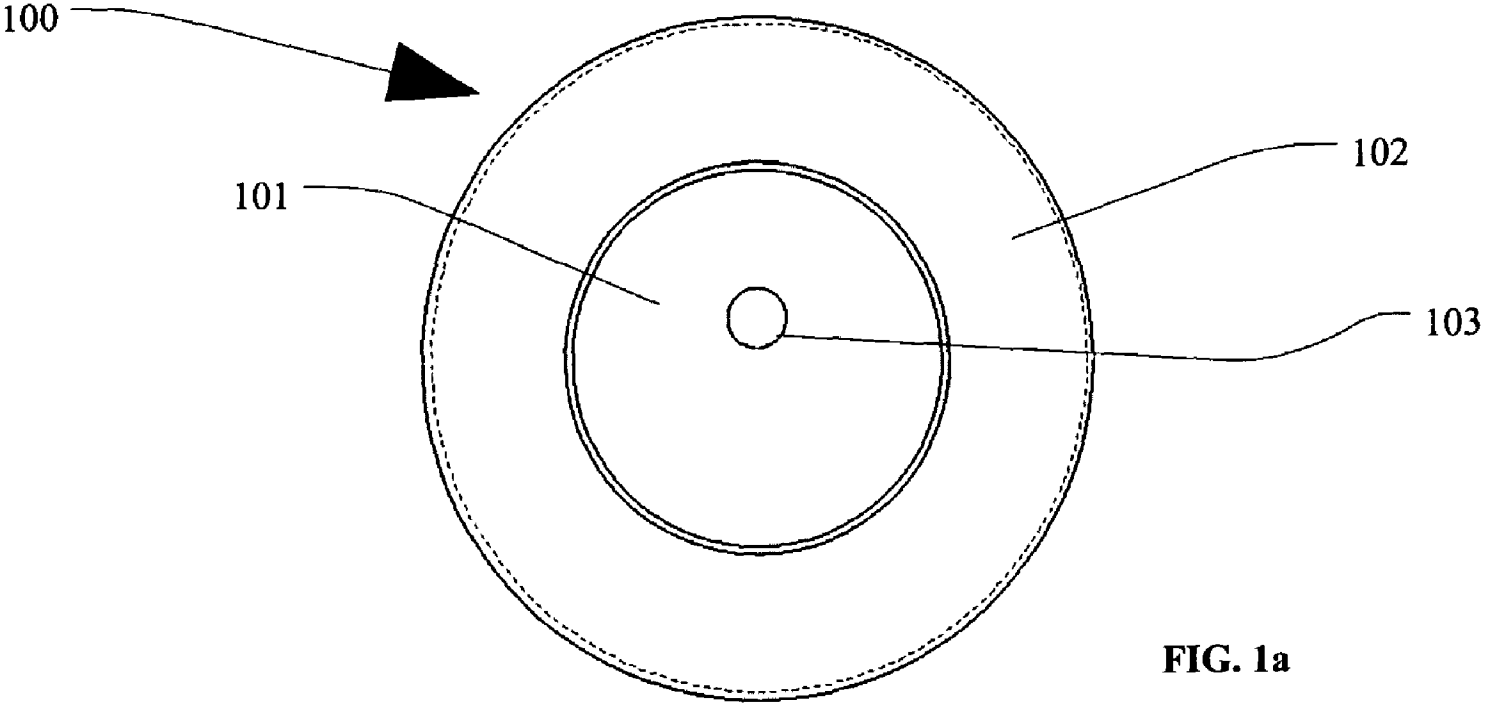
FIG. 1*a* is the top view of an exemplary implementation of a patch antenna, with metallization applied using a thick film or thin film process in accordance with one embodiment of the present invention.
Figure 1B:
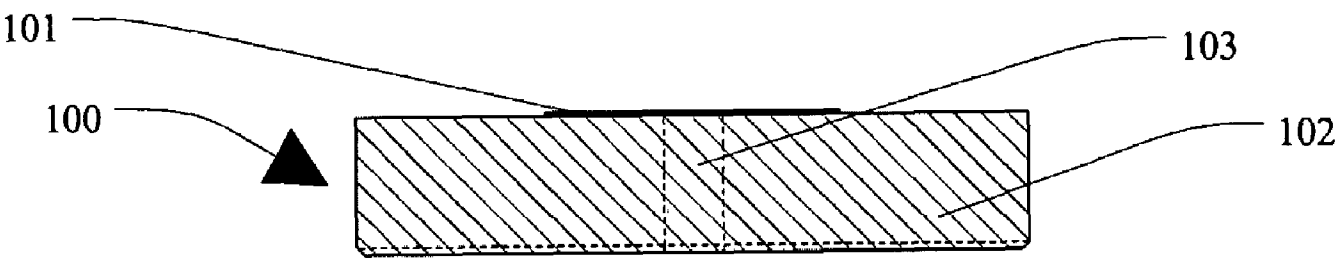
FIG. 1*b* is the side view of an exemplary implementation of a patch antenna, with metallization applied using a thick film or thin film process in accordance with one embodiment of the present invention.
Figures 2A, 2B:
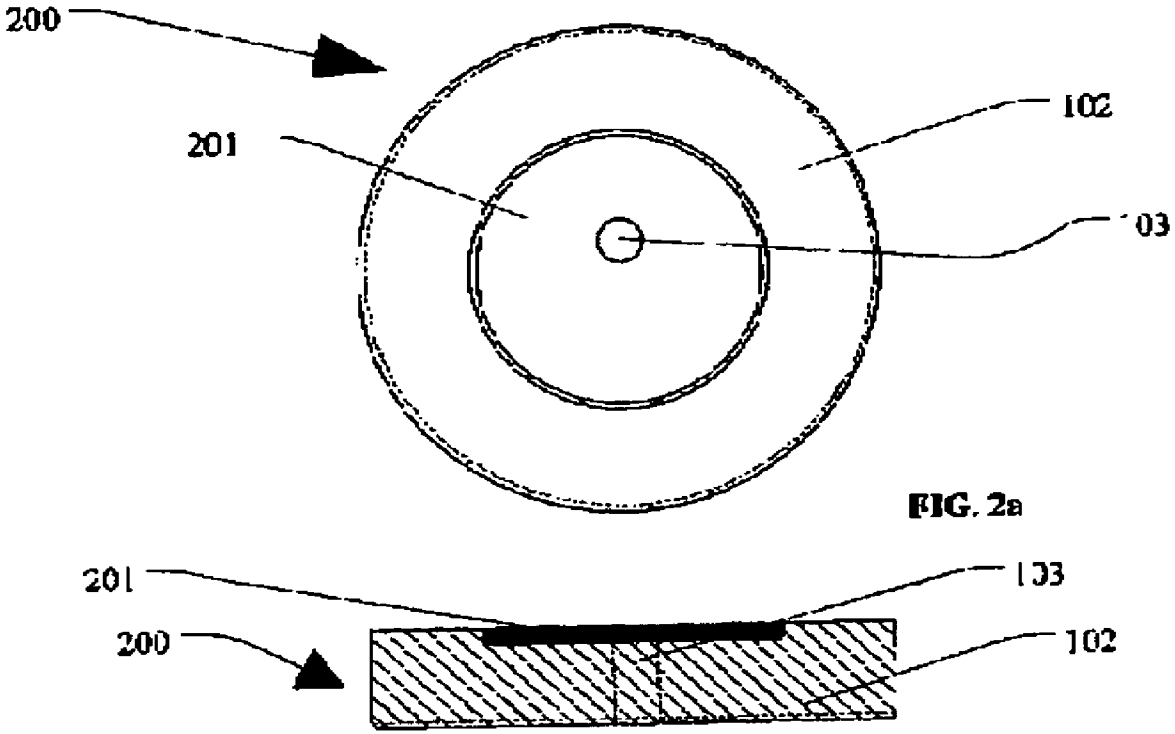
FIG. 2*a* is the top view of an exemplary implementation of a patch antenna with a main radiator comprising a solid piece of metal attached to a dielectric substrate in accordance with one embodiment of the present invention.
FIG. 2*b* is the side view of an exemplary implementation of a patch antenna with a main radiator comprising a solid piece of metal attached to a dielectric substrate in accordance with one embodiment of the present invention
Figure 3:
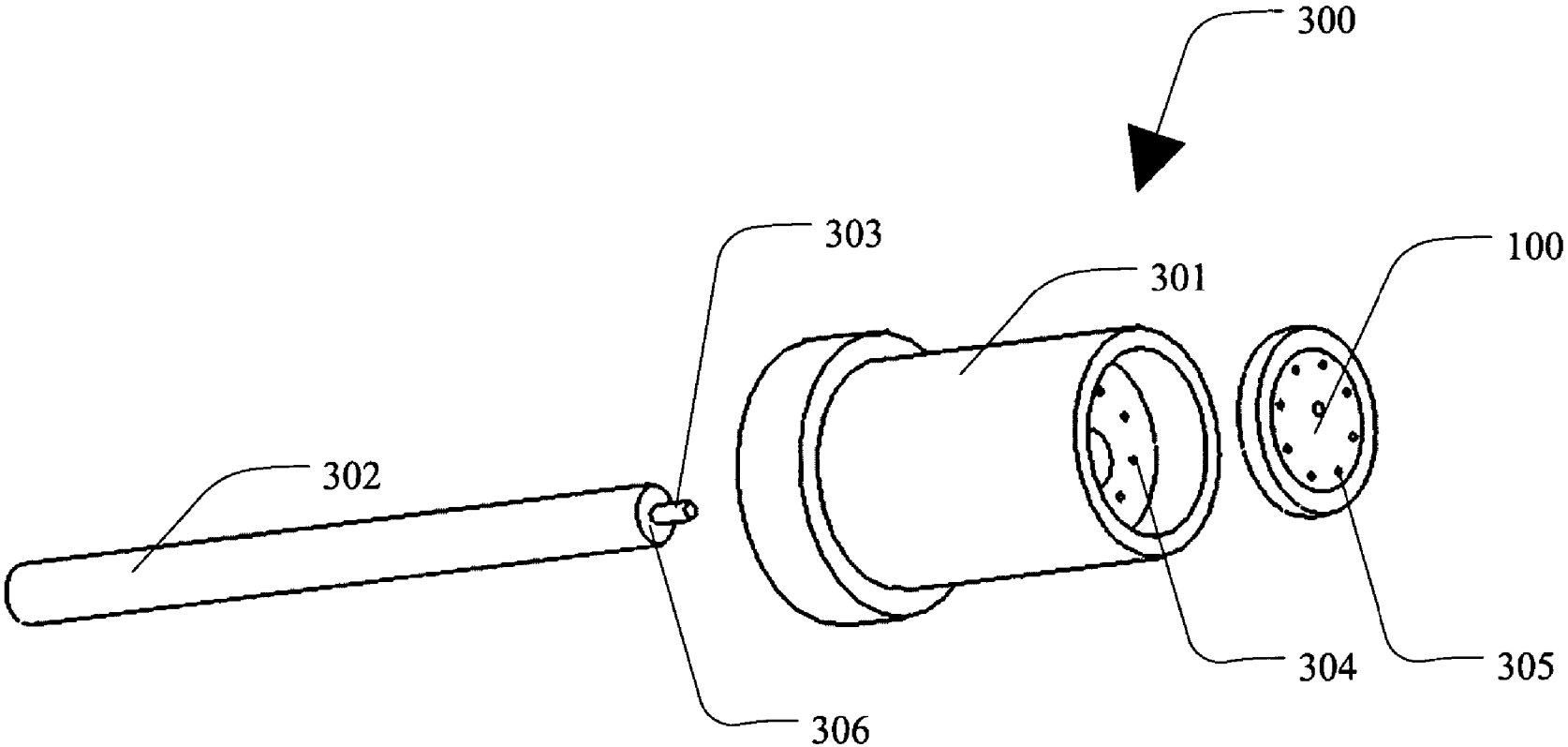
FIG. 3 is an assembly drawing of an exemplary implementation showing an assembly of a patch antenna, probe body, and cable in accordance with one embodiment of the present invention.
Figure 4:
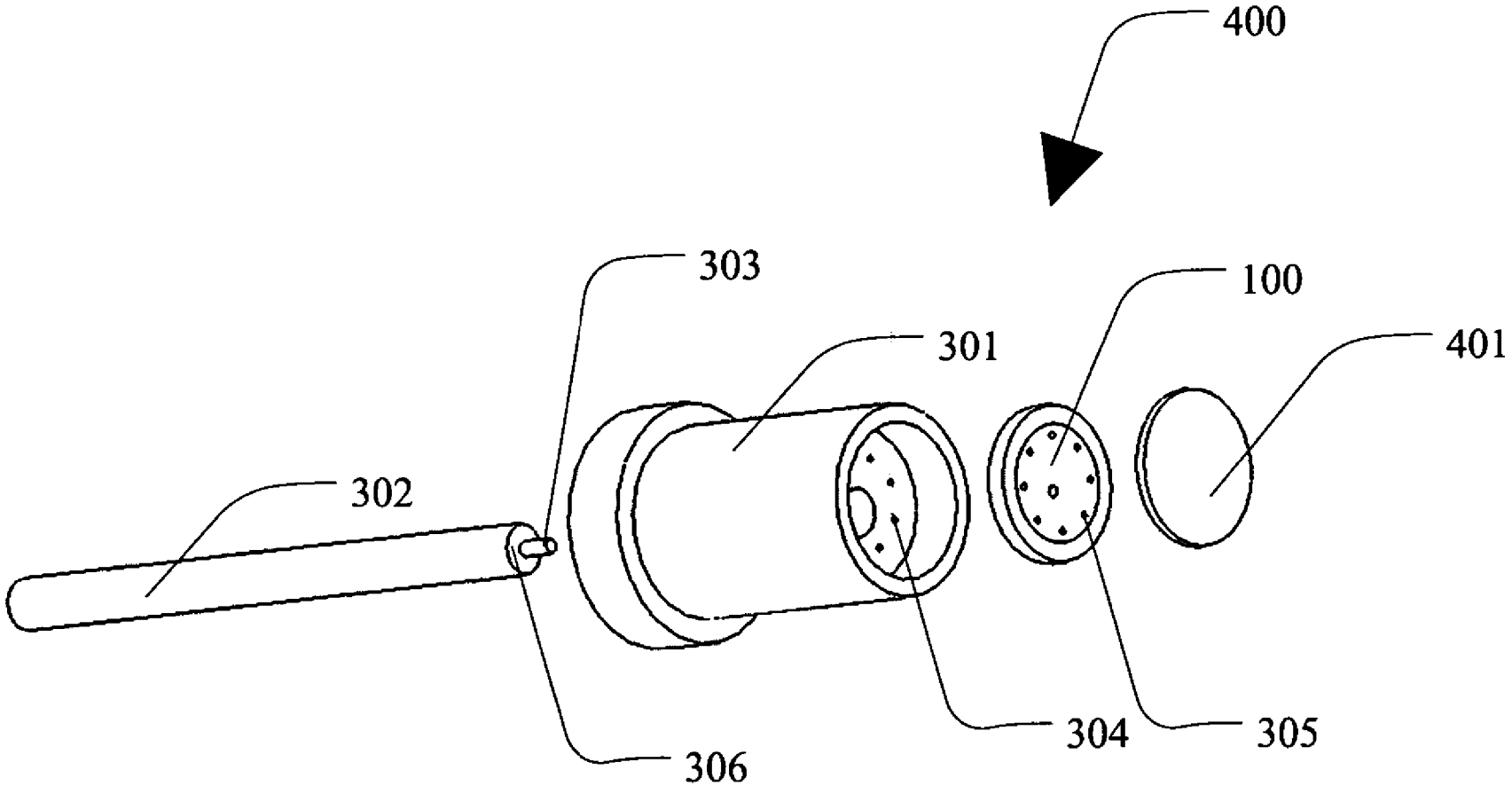
FIG. 4 is an assembly drawing of an exemplary implementation showing how the patch antenna, dielectric window, probe body, and cable in accordance with one embodiment of the present invention.
Figure 5:
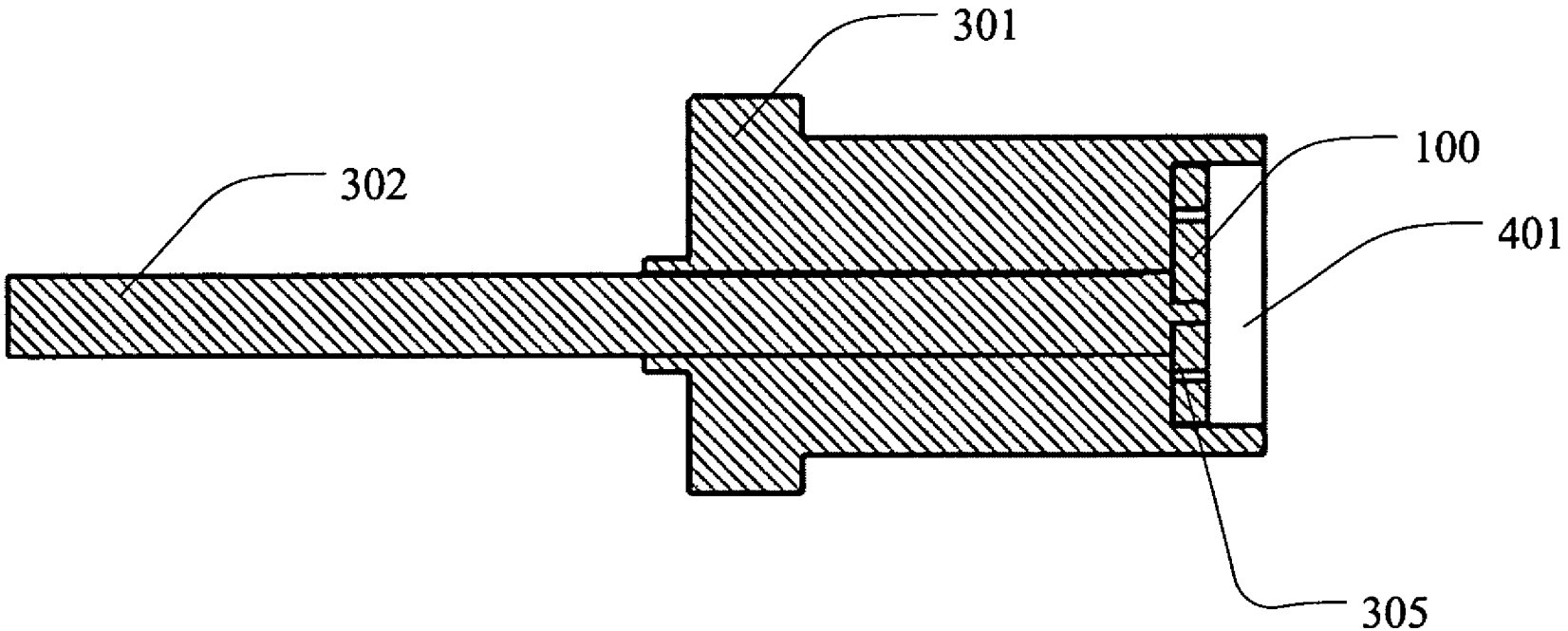
FIG. 5 is an exemplary cross section of an exemplary probe constructed in accordance with one embodiment of the present invention.
Figure 6:
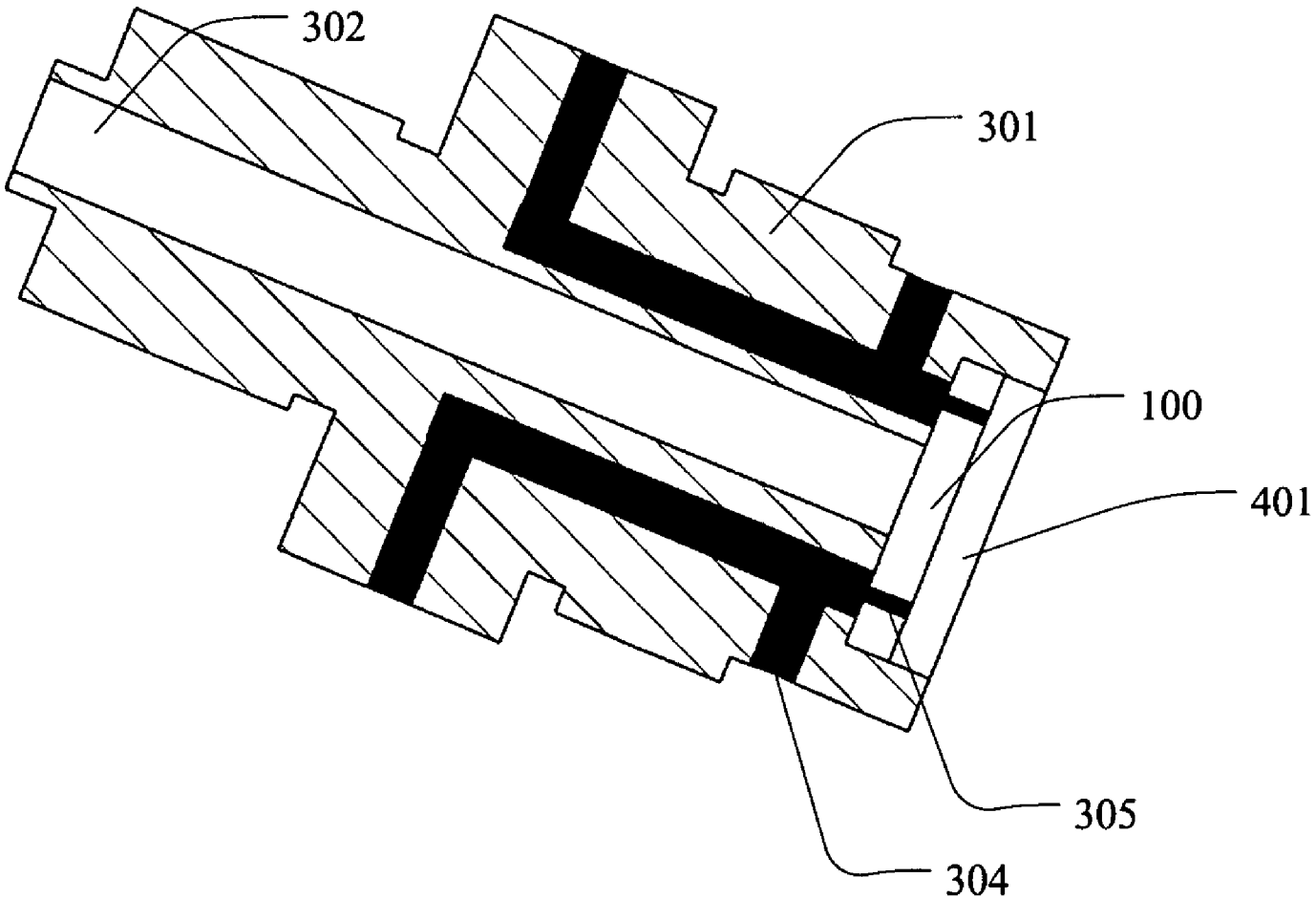
FIG. 6 is an exemplary cross section of an exemplary probe having cooling holes, constructed in accordance with one embodiment of the present invention.
Figure 7:
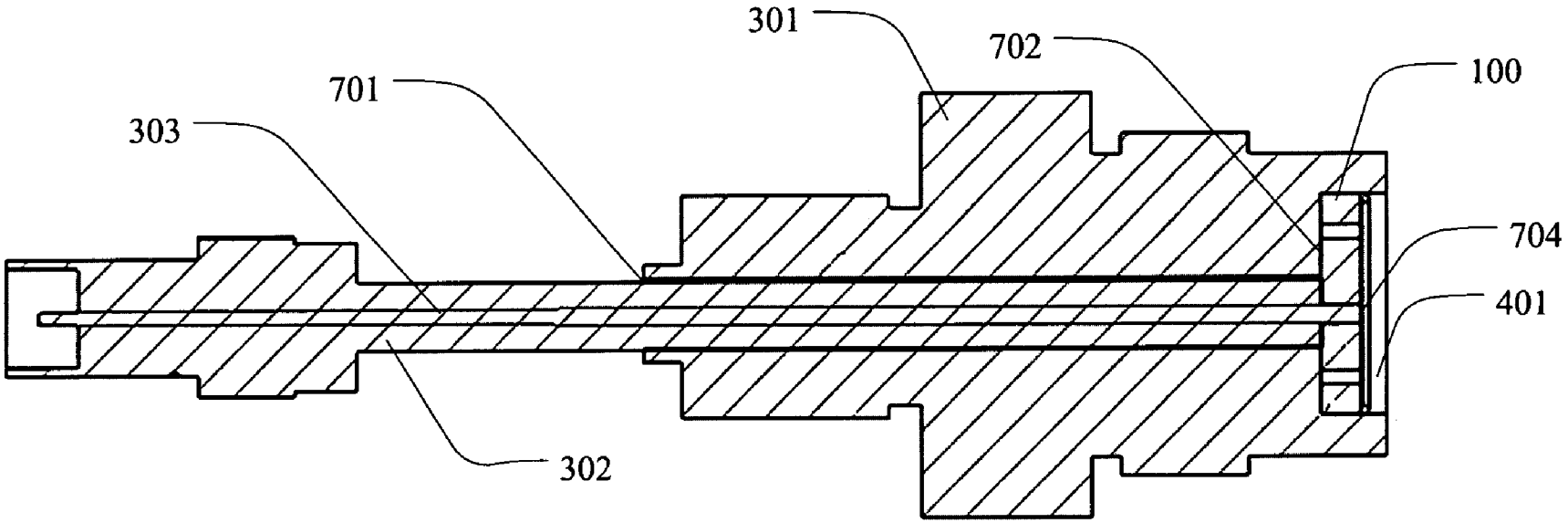
FIG. 7 is a schematic showing attachment points of an exemplary probe assembly in accordance with one embodiment of the invention.
Figure 8:
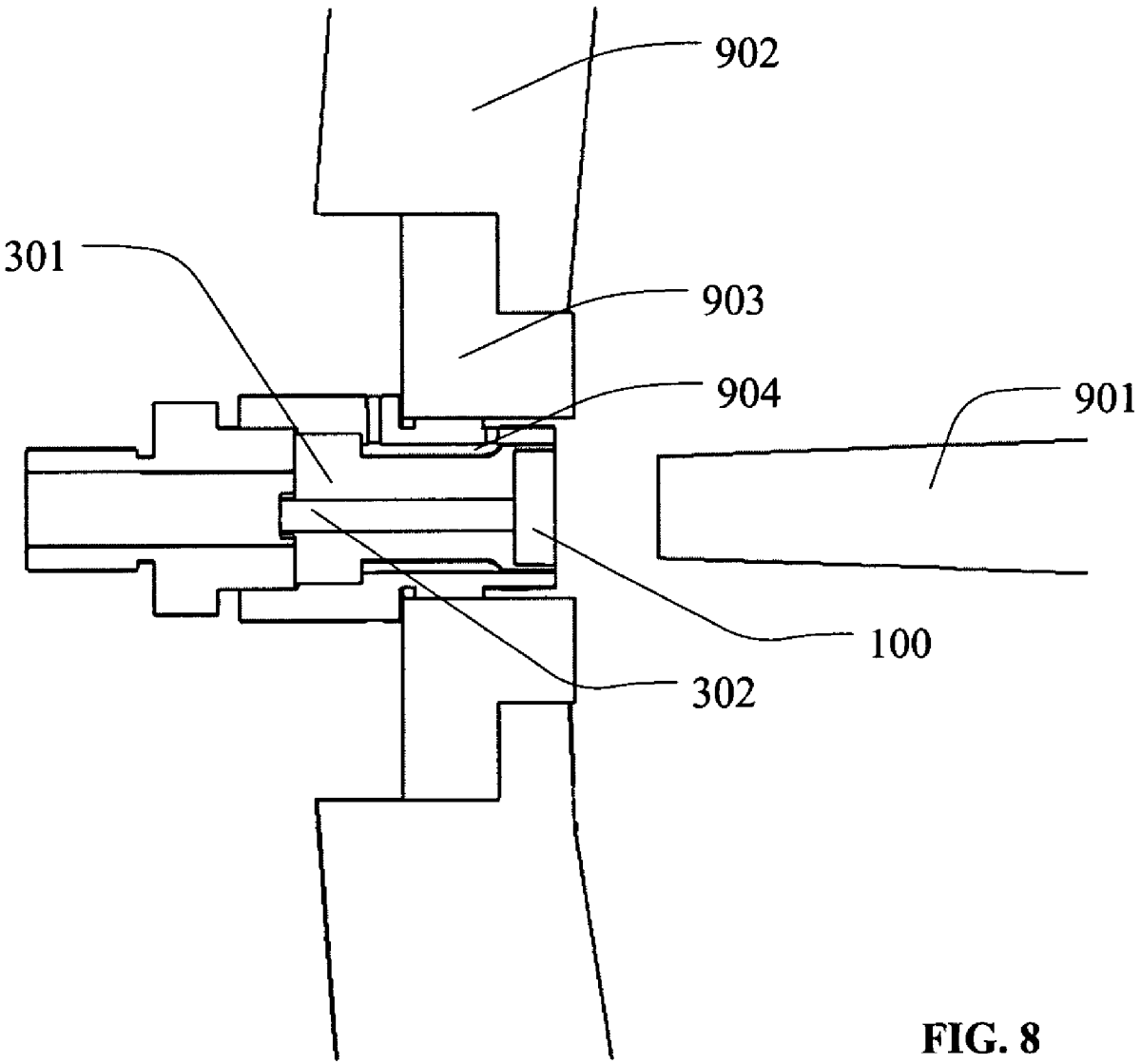
FIG. 8 is a block diagram of an exemplary implementation of a high temperature microstrip patch antenna within the representative operating environment of a turbine environment.

Exemplary embodiments of the present invention will now be described more fully hereinafter with reference to FIGS. 1-8, in which embodiments of the invention are shown. FIGS. 1-2 provide a schematic of exemplary implementations of patch antennas using different metallization techniques in accordance with one embodiment of the present invention. FIG. 3 provides an assembly drawing of an entire probe assembly without a dielectric window in front of the patch antenna in accordance with one embodiment of the present invention. FIG. 4 provides an assembly drawing of an entire probe assembly with a dielectric window in front of the patch antenna in accordance with one embodiment of the present invention. FIG. 5 is an exemplary cross section of a probe after assembly, including the patch antenna, dielectric window, probe body, and cable, in accordance with one embodiment of the present invention. FIG. 6 is an exemplary cross section of a probe containing cooling holes after assembly, including the patch antenna, dielectric window, probe body, and cable, in accordance with one embodiment of the present invention. FIG. 7 is a schematic showing the attachment points of an exemplary probe assembly in accordance with one embodiment of the invention. FIG. 8 is a block diagram of an exemplary implementation of a high temperature microstrip patch antenna within a turbine environment.

This invention can be embodied in many different forms and should not be construed as limited to the embodiments set forth herein; rather, these embodiments are provided so that this disclosure will be thorough and complete, and will fully convey the scope of the invention to those having ordinary sill in the art. Furthermore, all representative "examples" given herein are intended to be non-limiting, and among others supported by exemplary embodiments of the present invention.

FIG. 1 shows an exemplary patch antenna 100 comprising a dielectric substrate 102, a high temperature metallization 101 and a feed hole 103 for placing a microwave cable. The dielectric substrate 102 is typically a high temperature ceramic material, such as Coors AD995, which is a 99.5% pure alumina ceramic with a dielectric constant of approximately 9.7. As those versed in the art will know, the size of the microstrip patch antenna 100 is inversely related to the dielectric constant of the material used for the substrate 102 given a constant transmit frequency. For example, designing an antenna with a center frequency of approximately 5.8 GHz would yield a microstrip patch 100 of approximately 0.350 inches in diameter when using a Coors AD995 material. There are other high temperature materials that can be used as dielectric substrate 102, including but not limited to titania, zirconia, and silicon dioxide. Any material can be used as dielectric substrate 102 provided that the material has a dielectric constant compatible with the microwave design and the material properties arc such that the substrate will survive in the application. For example, Coors AD995 will survive in applications exceeding 2000° F.

There are additional ceramics available for use as the dielectric substrate 102 that add titania or calcium oxide additives to an alumina formula; these materials are known to significantly reduce the dielectric constant change as a function of temperature. Exemplary embodiments of the invention use these materials to minimize the change in antenna center frequency as a function of temperature.

The high temperature metallization 101 is a metal that is applied to dielectric substrate 102. Although the dielectric substrate 102 is capable of withstanding very high temperatures with high survivability in corrosive environments, the metallization 101 can be vulnerable over longer exposures. Materials include platinum-palladium-silver, rhenium, elemental platinum, and even conductive ceramics such as indium tin oxide. The geometry of the metallization 101 can be of any standard antenna design. To date, exemplary designs include a circular path or variants of a circular path, including a U-slot patch and a straight slot patch. Any geometry that achieves the desired center frequency and bandwidth could be used to implement the metallization.

The feed to the antenna is through hole 103. In exemplary designs, the center conductor of a coaxial cable is fed through hole 103 and bonded to metallization 101 using a braze, TIG welding, laser welding, or any other metal-to-metal joining technique, as known to those versed in the art. The antenna could be fed using a pin rather than a coaxial cable, or the feed could be redesigned to accommodate any other type of patch antenna feed found in the prior art.

The exemplary patch antenna can operate in support of transmission and reception of electromagnetic signals, while exposed to high temperatures, based on a selection of high temperature materials to prevent melting, oxidation, or chemical attack, as described above in connection with FIG. 1 and in more detail below in connection with the embodiments shown in FIGS. 2-8. High temperature joining techniques, such as brazing or diffusion bonding, are typically used to join components of the patch antenna.

FIG. 2 shows an exemplary patch antenna 200 comprising a dielectric substrate 102, a radiator disk 201 and a feed hole 103 for placing a microwave cable. The patch antenna 200 is identical to exemplary patch antenna 100 of FIG. 1, with the exception that the metallization 101 of FIG. 1 has been replaced with a solid disk of metal 201 in FIG. 2. Metallization 101 is normally applied using an ink process with the resulting thickness being several thousandths of an inch thick. In high temperature environments where oxidation is a concern, a more robust design can be achieved by adding a larger piece of solid metal 201, which can be brazed in place to the dielectric 102 or attached via any other metal to ceramic joining process found in the prior art.

Disk 201 can comprise a high temperature nickel alloy metal, such as Hastelloy-X or Haynes 230. The disk 201 can be made as thick as desired. Exemplary designs include a disk 201 having a thickness of up to 0.050". Larger thicknesses may be required depending on the application.

FIG. 3 is a probe assembly drawing. The exemplary probe 300 comprises a microstrip patch antenna 100 placed inside a housing or probe body 301. A microwave cable 302 is placed through the back side of the probe body 301, alternatively described herein as a housing, and attached to the antenna 100. The probe body 301 captures the radiator and cable and provides the appropriate outside dimensions to allow installation within a preferred operating environment, such as a machine. Typically, the probe body 301 will be circular, but can be adapted for any installation geometry required. The probe body 301 is typically made out of a high temperature metal, such as a nickel alloy, but any metal that has the required environmental characteristics for the installation can be used to implement the probe body. Sometimes, the probe body will be used as the electrical ground for the patch antenna 100. The probe body 301 aids in creating the antenna beam pattern via a ground plane that wraps around the antenna.

The cable 302 is typically a semi-rigid mineral insulated cable, using an insulator 306 such as silicon dioxide. These cables can be standard coaxial or triaxial cables with a traditional copper center conductor 303 and ground or a nickel alloy center conductor and ground for increased temperature resistance. The protective outer jacket of the cable 302 can be a stainless steel or a nickel alloy. The center conductor 303 is electrically attached to the patch antenna 100.

There are applications for the probe 300 where the air temperatures can exceed the melting points of the probe body 301. For these applications, passages or orifices, commonly referred to herein as holes, such as holes 304, can be drilled inside of the probe body 301. Additional passages or orifices, such as holes 305, can be drilled in the patch antenna 100. Exemplary installations of probe 300, such as in a gas turbine, can place the back of the probe body 301 within a cooler environment. Holes 304 and 305 allow cool air to pass through probe body 301 and radiator 100 to allow the probe to survive in the high temperature environment. An additional method of cooling uses an annular space or passage around the probe itself for cooling. For example, an annular passage can be placed adjacent to the dielectric material of the radiating element to support antenna cooling. These integral cooling orifices are useful for cooling and insulating the various components of the antenna 100.

Exemplary implementations of the patch antenna 100 include cooling holes 305 within the microwave design. The addition of cooling holes 305 into dielectric substrate 102 effectively reduces the dielectric constant by replacing high dielectric substrate material with air. With the addition of the cooling holes 305, the geometry of metallization 101 must be updated such that the resonant frequency of patch antenna 100 is at the desired frequency. The cooling holes 305 can be located outside of high temperature metallization 101 or placed in the geometry of high temperature metallization 101.

The cooling air distributed or passed by an orifice or passages provides other benefits for the inventive antenna, including 1) conductive cooling by direct contact with the probe surfaces (probe body, dielectric materials, conductive elements, and microwave cable); 2) providing an insulating layer of air in-between the probe body and the wall of the case; and 3) providing a boundary layer at the radiating element to protect it from high temperature gases.

FIG. 4 is a probe assembly drawing. The exemplary probe 400 comprises a microstrip patch antenna 100 placed inside of a probe body 301. A microwave cable 302 is placed through the back side of the probe body 301 and attached to the antenna 100. A dielectric window 401 is placed over microstrip patch antenna 100 in order to provide a thermal and environmental barrier that increases the life of probe 400 within a high temperature environment.

Probe 400 is identical to the probe 300 of FIG. 3 with the addition of the dielectric window placed over the top of microstrip patch antenna 100. The dielectric window 401 can be thin, on the order of several thousandths of an inch thick. Windows are typically applied using a plasma flame spray, with standard materials such as yittria-stabilized zirconia (YTZ). The flame spray provides an environmental barrier over metallization 101 that keeps oxygen from reaching the metal. This significantly reduces the oxidation rate of metallization 101 and extends the overall life within the high temperature application. In exemplary applications, the thickness of the dielectric window 401, when applied using a flame spray coating, is typically small enough to avoid having a significant effect on the microwave performance of patch antenna 100. Therefore, patch antenna 100 can normally be designed using standard antenna design techniques and the flame spray dielectric window 401 can be applied to patch antenna 100 at the end of the process without any appreciable change in antenna performance.

The dielectric window 401 also can be implemented as a thick disk of material placed over patch antenna 100. The window material can include alumina, silicon dioxide, or any other material deemed appropriate for the application, with a thickness of up to or exceeding one half an inch thick. When a large dielectric window is placed in front of patch antenna 100, the microwave performance of the antenna can be impacted. Therefore, when a thick dielectric window 401 is used, the microwave design will have to properly account for its presence by impedance matching the patch to the dielectric window.

A large dielectric window 401 is typically attached using a ceramic adhesive to bond the dielectric substrate 102. Other standard metal to ceramic techniques can be used to attach the dielectric window 401 to the high temperature metallization 101.

FIG. 5 shows a cross-section of a fully assembled probe without cooling holes in probe body 301. The cable 302 is inserted through a hole in the back of probe body 301 and attached to patch antenna 100. The probe body 301 provides the electrical ground connection between cable 302 and patch antenna 100. The entire assembly is preferably assembled in a manner that allows all of the metal pieces to have strong electrical grounds. Without a sufficient metal-to-metal contact, the antenna center frequency and notch depth can be adversely affected and antenna performance will be sub-optimal.

FIG. 6 shows a cross section of a fully assembled probe containing cooling holes 304 in probe body 301. For this embodiment, probe body 301 includes outer walls of a sufficient thickness to allow cooling holes 304 to be machined. Probe body 301 is typically installed in such a way that the cooling holes furthest away from patch antenna 100 are located in an area of relatively cool air while the holes through and above the patch antenna 100 are located within the high temperature environment. In a typical installation, such as a gas turbine engine, the cooler air passes through the probe body into the high temperature area. Along the way, the cooler air takes heat out of probe body 301, cable 302, and patch antenna 100. In exemplary designs within turbine engines, temperatures can be reduced by several hundred degrees Fahrenheit by the addition of the cooling holes in the probe body, which can significantly improve probe life. The cooling holes 304 shown in this exemplary design can be of any geometry that is compatible with the installation and environment and sufficient to support cooling flow to enable long life operation.

FIG. 7 shows a cross section of an exemplary probe assembly with areas of high temperature joining necessary in the probe assembly process. Joint 701 is typically a laser weld or TIG weld that attaches cable 302 with probe body 301. It is normally desirable to have joint 701 to be hermetic so that contamination of cable 302 is minimized.

Joint 702 is a ceramic to metal seal that attaches probe body 301 to the dielectric substrate 102. In exemplary designs, a vacuum brazed is used. However, air brazing, torch brazing, and diffusion bonding are additional ways to create the seal. Any conventional ceramic-to-metal seal methodology may be used to create the seal provided that the seal can handle the thermal and chemical environments where it is operating and provide the required hermetic seal for the cable.

Joint 704 attaches the center conductor of the cable 303 to the high temperature metallization 101 or disk 201. The attachment must provide sufficient electrical contact as to allow the microwave energy to transition from the cable to the patch antenna 100 with minimal signal reflections or losses. In exemplary implementations, a laser weld is used for the attachment. Brazing, TIG welding, induction heating, and any other metal to metal attachment process can be used without loss of generality.

FIG. 8 shows a typical probe installation inside of a gas turbine engine. The assembled probe comprises probe body 301, cable 302, and patch antenna 100 and supports a measurement of the distance to the turbine blade 901 rotating by the probe. The probe is mounted into the side of the turbine case 902 using a boss or other insert 903 which matches the dimensions of the hole in case 902 with the outer geometry of probe body 301. In the hottest areas of the engine, the gas going past turbine blade 901 can exceed 2000° F. This installation also shows the cooling holes in probe body 301 in this case, implemented as an annulus 904. By using an annulus instead of discrete cooling holes, a larger amount of air flow can be forced through the probe.

In view of the foregoing, it will be understood that the present invention comprises an antenna operational within a high temperature environment. An antenna radiating element, typically comprising a patch formed by a conductive element in contact with a dielectric element, is operative to communicate electromagnetic signals. The dielectric element of the antenna radiating element typically comprises a dielectric material exhibiting a low change in dielectric constant as a function of temperature. A housing comprising conductive material is operable to accept the antenna radiating element. This housing has one or more cooling orifices supporting the passage of air for cooling the antenna radiating element within the high temperature environment.

A high temperature microwave cable can be coupled to the antenna radiating element. The cable is typically inserted within the housing and attached to the conductive element of the antenna radiating element for the passage of electromagnetic signals to or from the radiating element.

A dielectric window can be positioned in front of the antenna radiating element and adjacent to the housing. The dielectric window comprising a dielectric material operative to provide additional thermal and environmental protection for the antenna radiating element. The dielectric window typically comprises a flame spray coating or a dielectric material.

The antenna radiating element is typically housed within at least a portion of the housing and joined to the housing by a bond capable of withstanding the high temperature environment. The housing can comprise a conductive material having dimensions sufficient to operate as a ground plane for the antenna radiating element.

The conductive element can comprise a metallization applied to a surface of the dielectric element. In the alternative, the conductive element can comprises a solid conductive material joined to a surface of the dielectric element. The conductive element typically has a geometry suitable for communication of electromagnetic signals.

The dielectric element can comprises one or more orifices or cooling holes to support the passage of air for cooling the antenna within the high temperature environment. In the alternative, the dielectric element can comprise an annular passage to support the passage of air for cooling the antenna within the high temperature environment. The antenna also can include one or more passages positioned adjacent to the dielectric element to support the passage of air for cooling the antenna within the high temperature environment.

The present invention also provides a method of manufacturing an antenna for operation within a high temperature environment. An antenna radiating element can be formed by joining a conductive element to a dielectric material element. At least one orifice is added to a housing for housing the antenna radiating element. Orifices can be added to the conductive element of the antenna radiating element to further support the distribution of air for cooling the antenna. Each orifice or cooling hole supports the passage of air from the exterior of the housing to the interior of the housing for cooling the antenna within the high temperature environment. The antenna radiating element is inserted within at least a portion of the housing and joined to the housing.

The present application has presented alternative exemplary embodiments of a patch antenna operable within a high temperature environment. Different applications will require different frequencies of operation, mechanical dimensions and geometries, and materials, which can be designed using techniques known to one versed in the art.

What is claimed is:

1. An antenna operational within a high temperature environment, comprising:

an antenna radiating element, comprising a patch formed by a conductive element in contact with a dielectric element, operative to communicate electromagnetic signals; and a housing comprising a conductive material and operable to accept the antenna radiating element, the housing having one or more cooling orifices and at least one passage supporting a flow of air for cooling the antenna radiating element within the high temperature environment of greater than 600 degrees Fahrenheit, at least one of the cooling temperature positioned along the housing and away from the antenna radiating element to distribute cooling air through the passage and within the housing to another one of the cooling orifices located adjacent to the antenna radiating element, whereby the flow of cooling air supports conductive cooling by direct contact with the housing and the antenna radiating element and provides a boundary layer proximate to the antenna radiating element for protection from gases generated by the high temperature environment.

2. The antenna of claim 1 further comprising a high temperature microwave cable coupled to the antenna radiating element, the cable inserted within the housing and attached to the conductive element of the antenna radiating element for the passage of electromagnetic signals to or from the radiating element.

3. Thy antenna of claim 1 further comprising a dielectric window positioned in front of the antenna radiating element and adjacent in the housing, the dielectric window comprising a dielectric material operative to provide additional thermal and environmental protection for the antenna radiating element.

4. The antenna of claim 3, wherein the dielectric window comprises one of a flame spray coating and the dielectric material.

5. The antenna of claim 1, where the antenna radiating element is housed within at least a portion of the housing and joined to the housing by a bond capable of withstanding the high temperature environment.

6. The antenna of claim 1, wherein the housing comprises a conductive material having dimensions sufficient to operate as a ground plane for the antenna radiating element.

7. The antenna of claim 1, wherein the antenna radiating element comprises a dielectric material exhibiting a low change in dielectric constant as a function of temperature.

8. The antenna of claim 1, wherein the conductive element comprises a metallization applied to a surface of the dielectric element, the conductive element having a geometry suitable for communication of electromagnetic signals.

9. The antenna of claim 1, wherein the conductive element comprises a solid conductive material joined to surface of the dielectric element, the conductive element having a geometry suitable for communication of electromagnetic signals.

10. The antenna of claim 1, wherein the dielectric element comprises one or more orifices to support the passage of air for cooling the antenna within the high temperature environment.

11. The antenna of claim 1, wherein thy dielectric element comprises an annular passage to support the passage of air for cooling the antenna within the high temperature environment.

12. The antenna of claim 1 further comprising one or more passages positioned adjacent to the dielectric element to support the passage of air for cooling the antenna within the high temperature environment.

13. An antenna operational within a high temperature an external environment exhibiting a high temperature of greater than 600 degrees Fahrenheit comprising:

an antenna radiating element, comprising a patch formed by a conductive element in contact with a dielectric material element, operative to communicate electromagnetic signals;

a housing comprising a conductive material and operable to accept the antenna radiating element, the housing having at least one a plurality of orifices and at least one passage supporting flow of air from the exterior of the housing to the interior of the housing for cooling the antenna within the external high temperature environment at least one of the orifices positioned along the housing and away from the antenna radiating element to distribute cooling air through the passage and within the housing to another one of the orifices located adjacent to the antenna radiating element; and a dielectric window positioned in front of the antenna radiating element and adjacent to the housing, the dielectric window comprising a dielectric material operative to provide thermal and environmental protection for the antenna radiating element.

14. The antenna of claim 13 further comprising a high temperature microwave cable coupled to the antenna radiating element, the cable inserted within the housing of the housing and attached to the conductive element of the antenna radiating element for the passage of electromagnetic signals to or from the radiating element.

15. The antenna of claim 13, wherein the dielectric material element of the antenna radiating element comprises at least one orifice to further support a passage of air for cooling the antenna within the high temperature environment.

16. The antenna of claim 13 further comprising one or more passages positioned adjacent to the dielectric material element to support the passage of air for cooling the antenna within the high temperature environment.

17. A method of manufacturing an antenna for operation within a high temperature environment of at least 600 degrees Fahrenheit, comprising the steps of forming an antenna radiating element by joining a conductive element to a dielectric material element;

adding at toast one orifice to a housing for housing the antenna radiating element, each orifice supporting the passage of air from the exterior of the housing to the interior of the housing for cooling the antenna within the high temperature environment;

adding at least one passage to the dielectric material element of the antenna radiating element to further support the distribution of air for cooling the antenna; and inserting the antenna radiating element within at least a portion of the housing.

18. The method of claim 17 further comprising the step of joining the antenna radiating element to the housing.

19. The method of claim 18 further comprising the step of adding a plurality of orifices to the conductive element of the antenna radiating element to further support the distribution of air for cooling the antenna.

20. An antenna operational within a high temperature environment comprising:

antenna radiating element for communicating electromagnetic signals, the antenna radiating element comprising a patch formed by a conductive element in contact with a dielectric element comprising one or more orifices to support the passage of air for cooling the antenna within the high temperature environment; and a housing comprising conductive material and operable to accept the antenna radiating element, the housing having one or more cooling orifices supporting the passage of air for cooling the antenna radiating element within the high temperature environment.

21. The antenna of claim 20, wherein the antenna radiating element comprises a dielectric material exhibiting a low change in dielectric constant as a function of temperature.

22. The antenna of claim 20 further comprising one or more passages positional adjacent to the dielectric element to support the passage of air for cooling the antenna within the high temperature environment.

23. The antenna of claim 20, where the antenna radiating element is housed with at least a portion of the housing and joined to the housing by a bond capable of withstanding the high temperature environment.

24. The of claim 20, wherein the conductive element comprises a metallization applied to a surface of the dielectric element, the conductive element having a geometry suitable for communication of electromagnetic signals.

25. The antenna of claim 20, wherein the conductive element comprises a solid conductive material joined to a surface of the dielectric element, the conductive element having a geometry suitable for communication of electromagnetic signals.

26. An antenna operational within a high temperature environment comprising:

an antenna radiating element for communicating electromagnetic signals, the antenna radiating element comprising a patch formed by a conductive element in contact with a dielectric element comprising an annular passage to support the passage of air for cooling the antenna within the high temperature environment; and a housing comprising conductive material and operable to accept the antenna radiating element, the housing having one or more cooling orifices supporting the passage of air for cooling the antenna radiating element within the high temperature environment.

27. The antenna of claim 26, wherein the antenna radiating element comprises a dielectric material exhibiting a low change in dielectric constant as a function of temperature.

28. The antenna of claim 26 further comprising one or more passages positioned adjacent to the dielectric element to support the passage of air for cooling the antenna within the high temperature environment.

29. The antenna of claim 26, when the antenna radiating element is housed within at least a portion of the housing and joined to the housing by a bond capable of withstanding the high temperature environment.

30. The of claim 26, wherein the conductive element comprises a metallization applied to a surface of the dielectric element, the conductive element having a geometry suitable for communication of electromagnetic signals.

31. The antenna of claim 26, wherein the conductive element comprises a solid conductive material joined to a surface of the dielectric element, the conductive element having a geometry suitable for communication of electromagnetic signals.

* * * * *

UNITED STATES PATENT AND TRADEMARK OFFICE

CERTIFICATE OF CORRECTION

PATENT NO. : 7,283,096 B2
APPLICATION NO. : 11/351422
DATED : October 16, 2007
INVENTOR(S) : Jonathan L. Geisheimer et al.

It is certified that error appears in the above-identified patent and that said Letters Patent is hereby corrected as shown below:

Column 9, line 38, “temperature” should read --orifices--

Column 9, line 55, “Thy” should read --The--

Column 9, line 57, “in” should read --to--

Column 11, line 6, “toast” should read --least--

Column 11, line 24, insert --an-- before “antenna”

Column 11, line 39, “positional” should read --positioned--

Column 11, line 43, “with” should read --within--

Column 12, line 1, insert --antenna-- after “The”

Column 12, line 31, “when” should read --where--

Column 12, line 35, insert --antenna-- after “The”

Signed and Sealed this

Eighth Day of April, 2008

JON W. DUDAS
*Director of the United States Patent and Trademark Office*